US005164147A

United States Patent [19]

Bottinelli et al.

[11] Patent Number: 5,164,147

[45] Date of Patent: Nov. 17, 1992

[54] HEAT TREATING FURNACE

[75] Inventors: N. Edward Bottinelli, Dallas, Tex.; Norman L. Kotraba, Tega Cay, S.C.

[73] Assignee: Zia Patent Company, Dallas, Tex.

[21] Appl. No.: 654,996

[22] Filed: Feb. 14, 1991

[51] Int. Cl.[5] ..... C21B 7/00

[52] U.S. Cl. ..... 266/242; 432/247

[58] Field of Search ..... 266/153, 154, 197, 198, 266/177, 242, 255; 432/95, 247, 212, 206; 110/326; 373/156, 161, 162, 163; 220/669, 670, 671, 672, 501; 202/120, 121, 126, 127

[56] References Cited

U.S. PATENT DOCUMENTS 2,022,372 11/1935 Hopkins ..... 266/242
3,816,338 6/1974 Corson ..... 202/121
3,822,989 7/1974 Tschinkel ..... 432/95

FOREIGN PATENT DOCUMENTS 0186935 7/1907 Fed. Rep. of Germany ..... 202/120

*Primary Examiner*—Scott Kastler
*Attorney, Agent, or Firm*—Ralph H. Dougherty

[57] ABSTRACT

An improved furnace for heating or heat-treating of particulate materials, the furnace having an elongated body, preferably vertical, forming a triskele cylinder having a desired cross-sectional area defined by four (4) circles of identical diameter, a central circle, and three (3) tangential outer circles, the center of each tangential circle symmetrically placed 120 degrees about the central circle, each of said circles being connected by tangential arcs of about the same diameter as the circles. The furnace shell is a high performance corrosion resistant nickel-base alloy, including cobalt, chromium, and silicon, whereby the critical contents of cobalt and silicon provide improved sulfidation resistance.

17 Claims, 3 Drawing Sheets

HEAT TREATING FURNACE

FIELD OF THE INVENTION

The present invention relates to an improved furnace for heating or heat-treating of particulate materials, and more particularly the application relates to a vertical retort furnace.

BACKGROUND OF THE INVENTION

Most furnaces for heating of particulate materials, particularly elongated furnaces, are generally round in cross-section or have a square cross-section. For externally heated furnaces, especially induction furnaces having a round cross-section, the center is equidistant from all sides of the furnace or from the entire periphery, whereas in a furnace of any other standard cross-section, the center is not equidistant from the entire periphery of the furnace, which causes the furnace to tend to develop cold spots. In a round furnace, the coldest spot is the exact center.

Although applicants are aware of numerous furnace configurations, the invented configuration is believed to be heretofore unknown.

SUMMARY OF THE INVENTION

The furnace of the present invention is an elongated body, preferably vertical, wherein the furnace of a desired cross-sectional area is defined by four (4) circles of identical diameter, a central circle, and three (3) identical diameter outer circles at 60 degree angles, preferably tangential to the central circle, the center of each tangential circle being symmetrically arranged 120 degrees about the central circle, each of said circles being connected by tangential arcs of about the same radius as that of the circles.

The furnace shell is a high performance corrosion resistant nickel-base alloy, consisting essentially of 25 to 40 weight percent cobalt, 25 to 35 weight percent chromium, up to 20 percent iron, at least 2 percent silicon, up to 8 percent each, molybdenum and tungsten, but molybdenum and tungsten combined not exceeding 12 percent, up to 1.0 percent columbium, plus tantalum, up to 1.3 percent aluminum, up to 1.3 percent titanium, up to 0.2 percent carbon, up to 0.2 percent rare earth metals, up to 0.1 percent zirconium, up to 0.1 percent boron, up to 2.0 percent manganese, balance nickel, plus impurities, whereby the critical contents of cobalt and silicon are present to provide improved sulfidation resistance. Such alloy is the subject of Lai U.S. Pat. No. 4,711,763, which is incorporated herein by reference.

The present invention is particularly useful for vertical shaft retort furnaces, and for furnaces for heat treatment of hazardous materials such as electric arc furnace flue dust and agglomerates made therefrom.

OBJECTS OF THE INVENTION

The principal object of the invention is to provide an improved furnace configuration for use as a heat treating furnace for particulates.

Another object of the invention is to provide a furnace configuration for a vertical retort furnace.

A further object of the invention is to provide an improved retort furnace suitable for use in hostile environments.

It is also an object of the invention to provide an improved heat treating retort furnace which resists wear from abrasion of particulates moving therethrough.

It is another object of the invention to provide an improved furnace which provides uniform heating of the material contained therein.

BRIEF DESCRIPTION OF THE DRAWINGS

The foregoing and other objects will become more readily apparent by referring to the following detailed description and the appended drawings in which.

DETAILED DESCRIPTION

The cross-sectional configuration of the furnace is a triskele cylinder, i.e., the furnace has three arms extending equiangularly about a central point, each arm preferably having a length one and one-half the diameter, or three times the radius R of an arc in which each arm terminates, the center of each arc being on the center line of each arm, each arm being connected by a tangential arc $R_1$, which arc $R_1$ preferably is the same dimension as radius R.

To have the same cross-sectional area if the furnace were round, the radius would be more than double the radius of the arcs of the cross-section of the invented furnace. Thus it is readily seen that it would take more than twice as long for the heat to penetrate from the perimeter of the furnace to the center.

Figure 1:
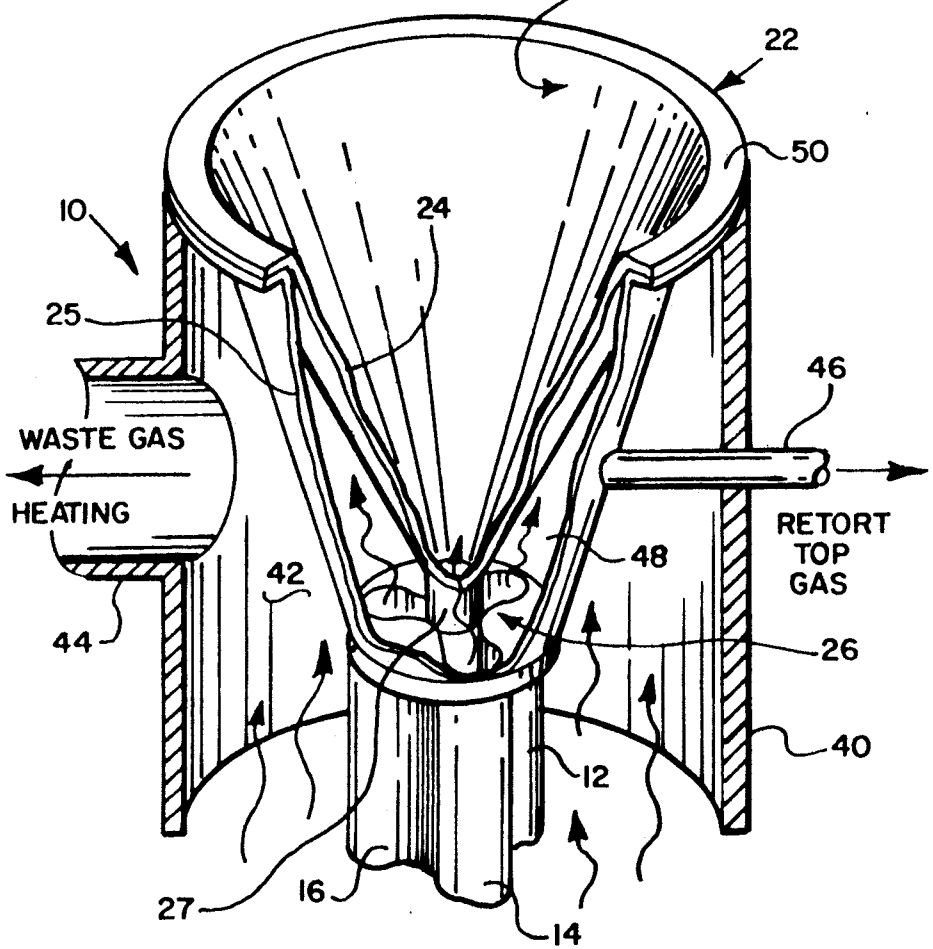
FIG. 1 is an isometric view, partially in section, with portions broken away, of the upper, or feed end, of the preferred embodiment of the invention, a vertical retort furnace.
Figure 3:
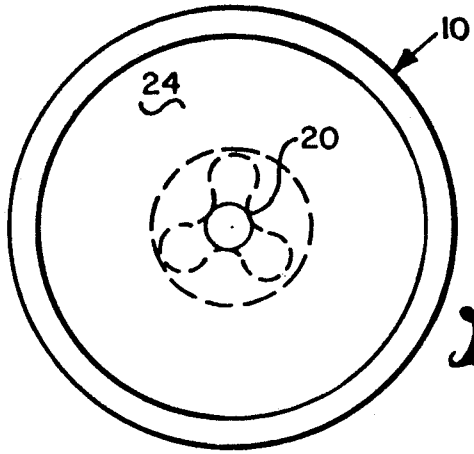
FIG. 3 is a top view of the furnace of FIG. 1.
Figure 4:
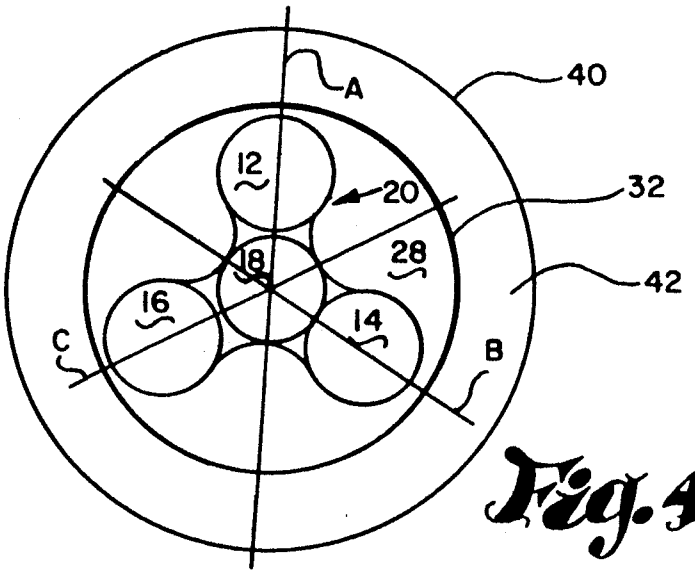
FIG. 4 is a horizontal cross section of the furnace of FIG. 1, taken at the center of its elevation.
Figure 5:
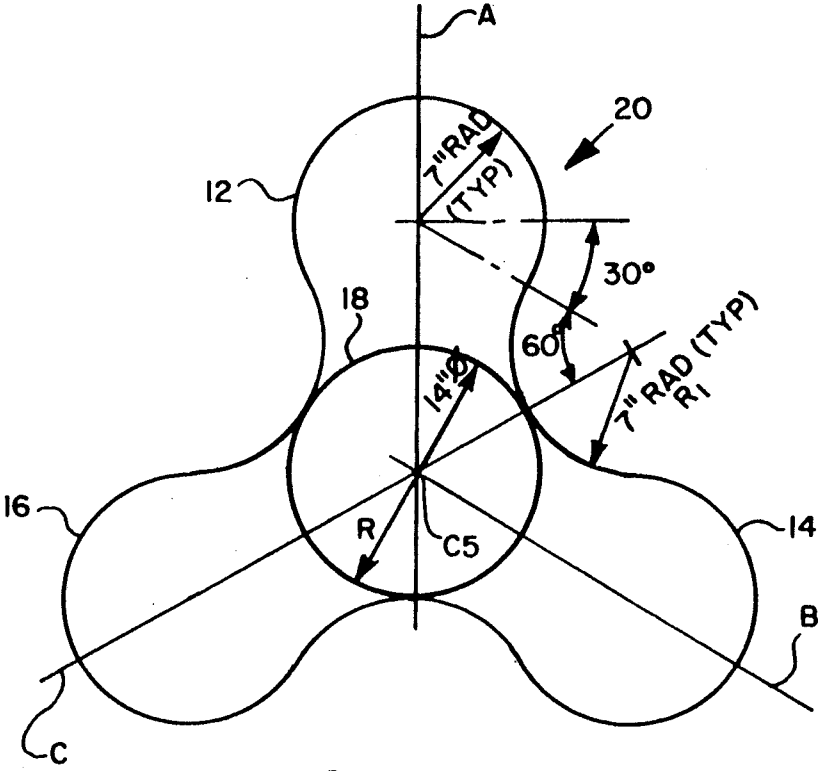
FIG. 5 is a diagrammatic cross-sectional view of the central furnace configuration showing the preferred relationships of the dimensions.

Referring now to the drawings, and particularly to FIGS. 1, 3 and 5, the invented furnace 10 has a distinctive interior shell configuration formed by three projecting vertical columns or arms 12, 14, 16, all of which are connected to the central portion 18 of the column by a radius $R_1$ which is tangential to the arc of each arm and to the circle defining the central portion 18. These vertical columns form a triskele cylinder 20, the length of each arm from the centroid $C_5$ being 3R. Along each of the center lines A, B, & C of the arms, there is no further point from the exterior of the furnace than from any other point on any of the three intersecting lines A, B, & C. Thus, the particulate material therein, such as iron ore pellets, will be evenly heated throughout any level of the burden with neither hot spots nor cold spots.

Figure 2:
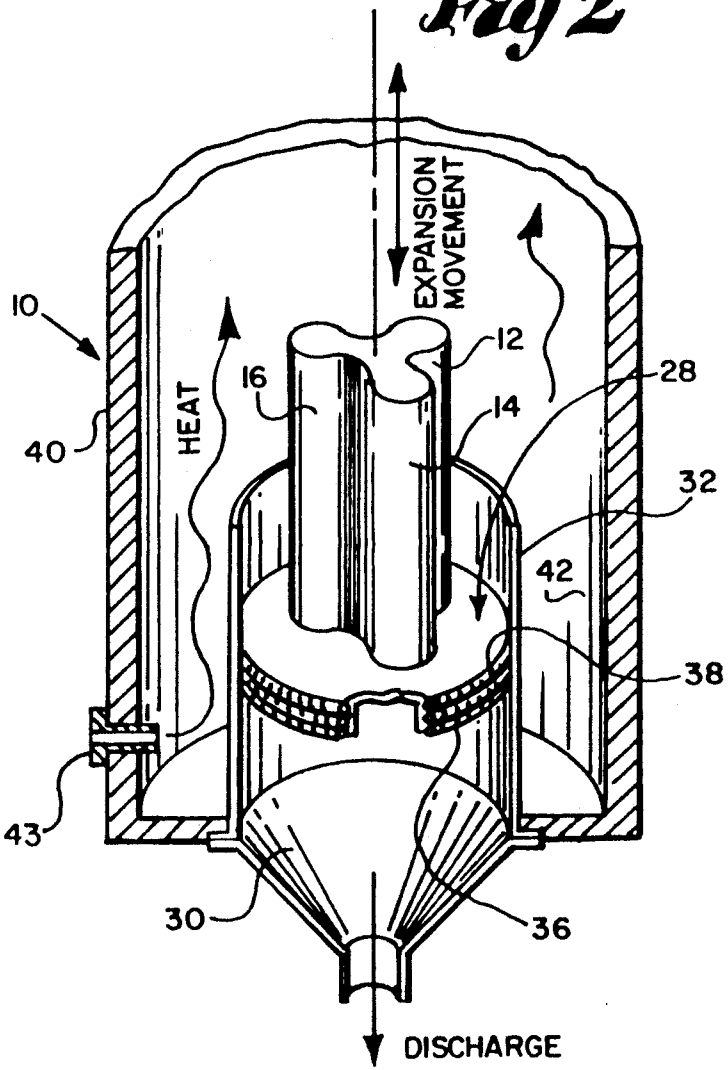
FIG. 2 is a partially sectioned isometric view with portions broken away, of the lower, or discharge end, of the vertical retort furnace of FIG. 1.

The furnace 10 has an inlet formed by charging chamber 22, which may be a single wall or preferably a dual wall feed bin with conical or sloping sides 24, for feeding the burden material to the interior of the furnace. The bottom of the chamber 22 mates with and is connected to upper transition plate or feed plate 26, and preferably has a discharge opening with the approximate dimensions of the circle defining the central portion 18 of the triskele cylinder 20, with which it is mated. A short charging tube 27 may be provided to connect the bottom of chamber 22 with the interior of the portion 18 at the top of cylinder 20. The outer wall 25 of charging chamber 22 is fixed to the outer edge of transition plate 26. Cylinder 20 is connected at its upper end to and suspended from the upper transition plate 26. The bottom of cylinder 20 is connected to a lower transition plate 28 above discharge chamber 30, as seen in FIG. 2. A tubular shell forms expansion guide 32 surrounding the cylinder 20. Lower transition plate 28 carries a downwardly projecting skirt 36, which is provided with an interior seal 38, preferably made of a high temperature resistant ceramic fiber rope, such as FIBERFRAX, manufactured by Kennecott Corporation. An outer furnace wall 40 defines a heating chamber 42 between the cylinder 20 and wall 40. The upper end of chamber 42 is provided with an exhaust gas outlet 44, and the upper end of the triskele cylinder 20 is likewise provided with an outlet for exhaust gas. The preferred arrangement is shown in FIG. 1 with outlet 46 communicating with the interior plenum chamber 48 formed by the walls 24 and 25 of the charging chamber and transition plate 26.

The charging chamber has an outer flange 50 which engages the upper end of furnace wall 40. The triskele cylinder 20 is suspended from its upper end and expands downwardly when heated. The shell of the retort (triskele cylinder 20) is thus maintained in tension, rather than compression, which avoids compressive failure.

Figure 6:
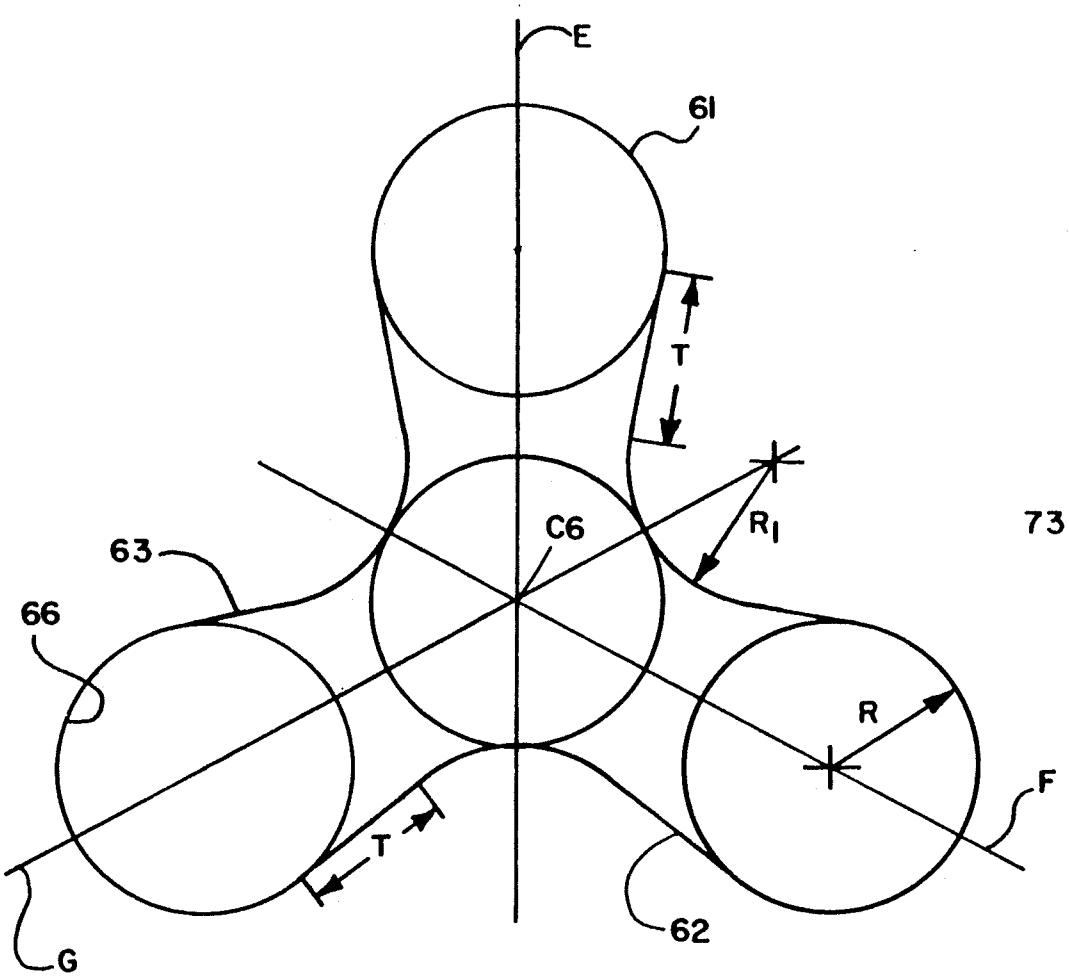
FIG. 6 is a diagrammatic cross-sectional view of an alternative embodiment of the central furnace configuration.

The alternative embodiment of FIG. 6 has elongated arms 61, 62, 63, and while the cross section does not make the most efficient use of shell material for heating of the interior of the triskele cylinder, it has no point on lines E, F, and G any further from the shell 66 than the center of the arc on each arm. The line T is tangent to the outer arcs of the arms 61, 62, 63, and to the inner arcs between each of the arms. Excessively long arms require a larger apparatus, which increases the cost of construction materials without any increase in return. The maximum effective length of each arm from the centroid $C_6$ is 4R.

Figure 7:
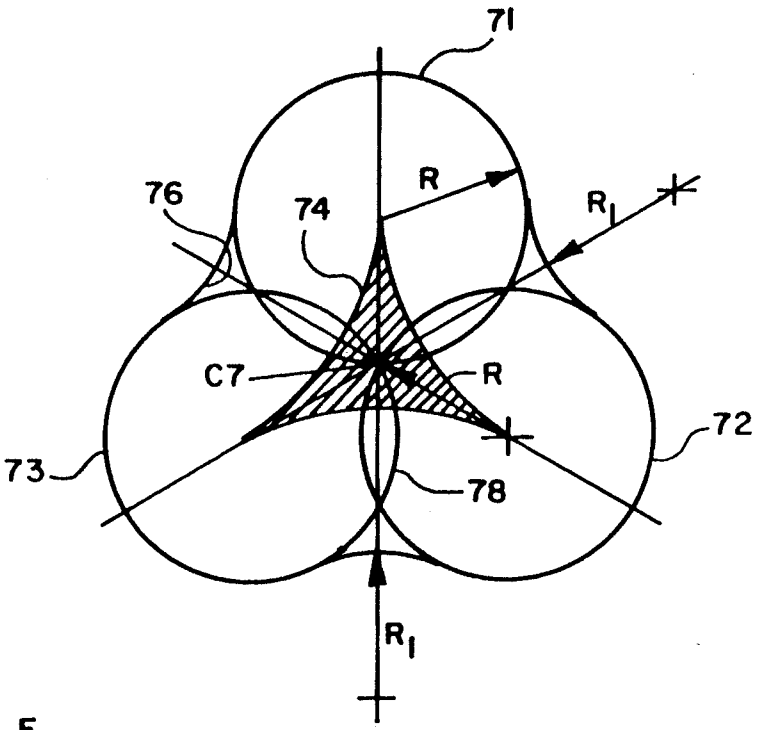
FIG. 7 is a diagrammatic cross-sectional view of a second alternative embodiment of the central furnace configuration.

The alternative embodiment of FIG. 7 has shortened arms 71, 72, 73, and while it is more efficient than a circular or rectangular cross section, the shaded area 74 defines the cold spot within the interior of the triskele cylinder, which is further from the shell 76 than the center of the arc on each arm. All of central circle 78 lies within the three overlapping circles of this embodiment of a triskele cylinder, the minimum effective length of each arm from the centroid $C_7$ being 2R.

Alternatively, the radius $R_1$ of the arcs tangential to the cylindrical sections can have a slightly larger or smaller radius than radius R of the cylinders, but preferably the arc radius $R_1$ is within 20% of the radius R of the cylinders. Any further deviation will result in uneven heating across the furnace cross-section.

In operation, heat, such as process waste heat through injector 43, heat from fuel fired burners, or induction heat, is provided to the space 42 exterior to the triskele cylinder 20 to heat the triskele cylinder 20 and the burden therein. The burden moves downwardly in the longitudinal direction of the cylinder 20, and being both solid and abrasive, would tend to score or wear a furnace made of conventional steel, since the furnace is not lined with refractory or other interior wearing surface. The upper transition plate 26, the triskele cylinder 20, the lower transition plate 28, and the expansion guide 32 are all made of high strength alloy, preferably a high performance corrosion resistant nickel-base alloy as described above.

SUMMARY OF THE ACHIEVEMENT OF THE OBJECTS OF THE INVENTION

From the foregoing, it is readily apparent that we have invented an improved triskele furnace configuration for use as a heat treating furnace for particulates or a vertical retort, which has a more even heat distribution throughout its cross section than heretofore has been possible.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An elongated vertical furnace having connected metal tubular portions each having the same cross sectional dimension and forming a triskele cylinder shell, which triskele cylinder shell is adapted for containing material therein, and means for heating said shell.

2. An elongated vertical furnace according to claim 1 further comprising vertical mounting means for encompassing said triskele cylinder and forming an outer heating chamber surrounding said triskele cylinder.

3. An elongated vertical furnace according to claim 2, further comprising heating means communicating with said outer chamber for heating said shell and the interior of said cylinder.

4. An elongated vertical furnace according to claim 3, further comprising means communicating with said outer chamber for removing exhaust gas from said outer chamber.

5. An elongated vertical furnace according to claim 1 wherein said shell is a steel alloy.

6. An elongated vertical furnace according to claim 1 wherein said triskele cylinder shell is a high performance corrosion resistant nickel-base alloy, consisting essentially of 25 to 40 weight percent cobalt, 25 to 35 weight percent chromium, up to 20 percent iron, at least 2 percent silicon, up to 8 percent each, molybdenum and tungsten, but molybdenum and tungsten combined not exceeding 12 percent, up to 1.0 percent columbium, plus tantalum, up to 1.3 percent aluminum, up to 1.3 percent titanium, up to 0.2 percent carbon, up to 0.2 percent rare earth metals, up to 0.1 percent zirconium, up to 0.1 percent boron, up to 2.0 percent manganese, balance nickel, plus impurities, whereby the critical contents of cobalt and silicon are present to provide improved sulfidation resistance.

7. An elongated vertical furnace according to claim 2 further comprising support means communicating with said vertical mounting means for supporting said shell and for centrally spacing said shell within said outer chamber.

8. An elongated vertical furnace according to claim 1, further comprising means communicating with the interior of said cylinder for removing exhaust gas from the interior of said cylinder.

9. An elongated vertical furnace according to claim 1, further comprising upper feed means and lower discharge means communicating with said cylinder.

10. An elongated vertical furnace according to claim 7, wherein said cylinder is supported and suspended from its upper end within said furnace, whereby said cylinder is maintained in tension at all times.

11. An elongated vertical furnace according to claim 7, further comprising an expansion guide within said outer chamber adapted receiving the bottom of said cylinder for vertical movement of said cylinder therein.

12. An elongated vertical furnace according to claim 11, wherein said expansion guide is a cylinder having a round horizontal cross section.

13. An elongated vertical furnace according to claim 11, further comprising sealing means between the interior of said cylinder and said outer chamber.

14. An elongated vertical furnace according to claim 13, wherein said sealing means is a high temperature resistant ceramic fiber rope.

15. An elongated vertical furnace according to claim 1 wherein said triskele cylinder has three equal length arms equiangularly arranged about a centroid.

16. An elongated vertical furnace according to claim 15 wherein the extremities of said arms terminate in a radius of a circle, all radii being the same dimension.

17. An elongated vertical furnace according to claim 1 wherein the length of each arm from the centroid is from 2 to 4 times said radius.

* * * * *